United States Patent [19]

Leach

[11] Patent Number: 5,071,317

[45] Date of Patent: Dec. 10, 1991

[54] CENTRIFUGAL PUMP HAVING A UNITARY ONE-PIECE DIFFUSION CASING AND A UNITARY ONE PIECE TURBINE IMPELLER UNIT

[76] Inventor: Alan Leach, 461 Oakleaf Trail, Suwanee, Ga. 30174

[21] Appl. No.: 533,086

[22] Filed: Jun. 4, 1990

[51] Int. Cl.[5] ..... F01D 1/02

[52] U.S. Cl. ..... 415/199.2; 415/182.1; 415/200; 415/228; 415/229

[58] Field of Search ..... 415/182.1, 229, 198.1, 415/199.1, 199.2, 199.3, 200, 203, 206, 228; 417/244, 423.5, 423.12

[56] References Cited

U.S. PATENT DOCUMENTS

| | | | |
|---|---|---|---|
| 8,890 | 4/1852 | Lebby | 415/198.1 |
| 898,624 | 9/1908 | Baldwin | 415/199.1 |
| 1,207,546 | 12/1916 | Hards | 415/199.1 |
| 1,546,862 | 7/1925 | Ostenberg | 415/182.1 |
| 1,547,371 | 7/1925 | Emerson | 415/182.1 |
| 1,929,813 | 10/1933 | Evans | 415/199.1 |
| 2,072,033 | 2/1937 | Frohnert | 415/199.1 |
| 2,219,098 | 10/1940 | Dorer | 415/198.1 |
| 2,910,223 | 10/1959 | Schlumbohm | 415/199.1 |
| 3,095,821 | 7/1963 | Elenbaas | 415/228 |
| 3,118,385 | 1/1964 | Yates | 415/199.1 |
| 3,146,939 | 9/1964 | Schlumbohm | 415/182.1 |
| 3,751,180 | 8/1973 | Carmercon . | |
| 3,782,851 | 1/1974 | Hackbarth . | |
| 4,243,357 | 1/1981 | Flynn et al. | 415/228 |
| 4,281,964 | 8/1981 | Jinkins . | |
| 4,305,192 | 12/1981 | Becker . | |
| 4,653,976 | 3/1987 | Blair et al. | 415/198.1 |
| 4,938,661 | 7/1990 | Kobayashi et al. | 415/199.1 |

*Primary Examiner*—Edward K. Look
*Assistant Examiner*—Christopher M. Verdier
*Attorney, Agent, or Firm*—James A. Hinkle

[57] ABSTRACT

A multiple-stage pump has a one-piece diffusion casing and a one-piece multiple turbine impeller. The casing has multiple diffusion chambers enclosing respective multiple impeller sections. The casing and the impeller have adjacently disposed surfaces at predetermined locations to form a discrete area between the surfaces to provide a dynamic bearing means.

6 Claims, 4 Drawing Sheets

Fig_6
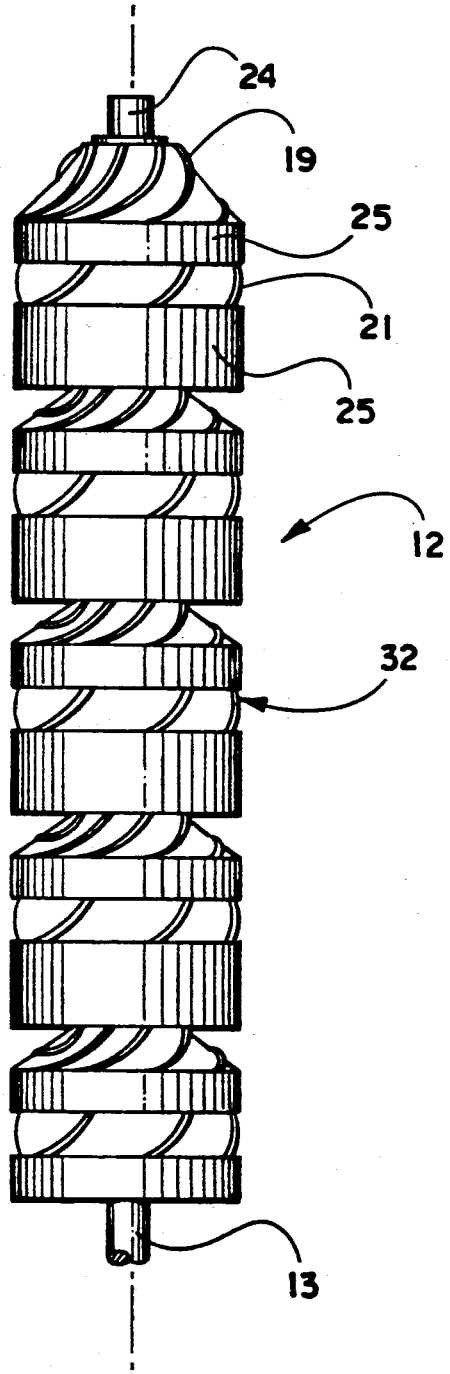
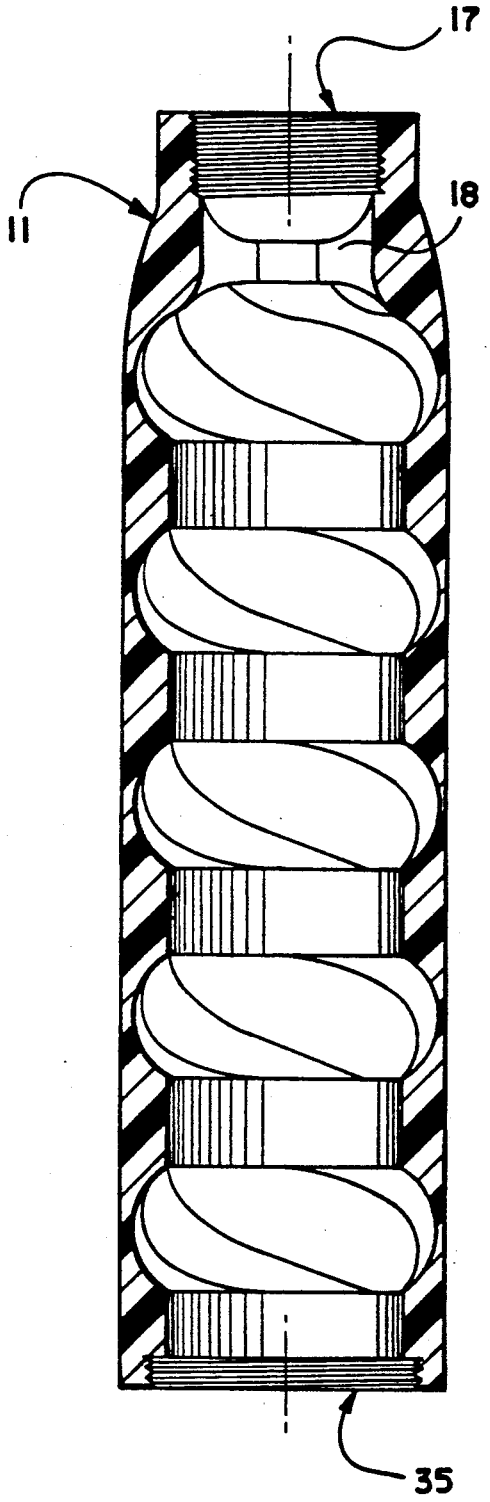
Fig_7

CENTRIFUGAL PUMP HAVING A UNITARY ONE-PIECE DIFFUSION CASING AND A UNITARY ONE PIECE TURBINE IMPELLER UNIT

BACKGROUND OF THE INVENTION

I. Field of the Invention

The present invention is directed to pumps and pertains more particularly to a pumping device, preferably for pumping water but not limited thereto, which incorporates a new and novel design for a multiple-stage pump having a mere two (2) main components comprising a one-piece diffusion casing and a one-piece multiple turbine impeller.

II. Description of the Prior Art

In the prior art, turbine type pump housings have been formed by placing together a plurality of housing sections and joining the housing sections together at mating wall portions. Turbine centrifugal pumps have changed little since their development early in the twentieth century. As in most centrifugal pumps, water flow and pressure is produced as a result of a vaned impeller rotating on a shaft. The impeller forces water upward through a volute or "bowl" designed to be hydraulically compatible with the impeller. Each impeller is fastened to a central shaft and the resulting assembly is normally supported by an individual sleeve-type bushing and wear ring arrangement. Since the hydraulic design of the impeller within a bowl dictates the flow through the pump and the pressure delivered by the pump, performance conditions are virtually fixed at a given speed. However, pressure may be increased arithmetically by stacking or staging the impeller bowl combinations, provided the driving horsepower of the pump is also increased.

In effect, a multi-stage vertical turbine pump is assembled by stacking a pre-determined multitude of individual stages, which stages generally consist of a shaft impeller, bowl bearings, wear rings, bolting and casing. The materials from which the stages are constructed generally range from bronze to cast iron or plastic. The application and the concern for cost effectiveness usually dictates the materials which are employed in the construction of such pumps. With the increase in the number of parts within the prior art pumps to provide the number of stages required for a particular application, there comes a corresponding increase in the cost of the pump because of the multitude of parts involved and the difficulty by which the parts are manufactured and assembled.

SUMMARY OF THE INVENTION

It is a primary object of the present invention to provide a pump having essentially a unitary, one-piece diffusion casing and a unitary, one-piece multiple turbine impeller. The simplicity of design and construction of such an arrangement constitutes a significant cost advantage over the pumps of the prior art. From both a manufacturing and marketing standpoint, such a design would be extremely advantageous in the submersible turbine pump application area.

A one-piece unitary diffusion casing of the present invention functions by efficiently moving water through the water passages of the casing in conjunction with the propelling action of the impeller without the necessity of stacking many similar components one atop the other. The casing may be configured either for line shaft use or submersible application with only minor design changes.

The length and number of diffusion cycles of the casing may be increased for higher pressure requirements, or conversely, decreased for less pressure. The length variation of the casing must be accompanied by corresponding changes in the impeller length. The resulting pressure increases are only limited by the available horsepower driving the pump and the tensile strength of the materials of construction.

The number of individual vanes in each diffusion cycle may be varied to accommodate the number of vanes employed in the impeller in order to accomplish the desired purpose. The recurring diffusion casing incorporates its own wearing surfaces which are lubricated by the water flowing therethrough, as opposed to the normal individual wear rings in traditional turbine design, thereby giving a high ratio of wear surface.

The unitary one-piece multiple turbine impeller functions in a similar manner to the traditional vertical turbine impeller, with the exception that the present invention provides a one-piece construction as opposed to stacking of various impellers, one atop the other. Much like the conventional construction of impellers, the number of vanes, their shape, angle and thickness may be changed to meet various hydraulic conditions. The present impeller, however, is designed to provide a large amount of built-in wear surfaces to eliminate the need for additional individual wear components such as wear rings, bearings and the like. It is anticipated that in the present invention the impeller, operating in conjunction with the recurring diffusion casing, will have precise tolerances as close as 0.010 inch clearance depending, of course, on the size of the particular pump involved. Such a minimum clearance provides a film of water as lubricant between the impeller and the casing, and also insures smooth operation.

BRIEF DESCRIPTION OF THE DRAWINGS

FIG. 6 is an elevation view of the impeller;

FIG. 7 is a vertical section view of the unitary diffusion casing of the pump with the impeller removed;

DETAILED DESCRIPTION OF THE PREFERRED EMBODIMENT

Figure 1:
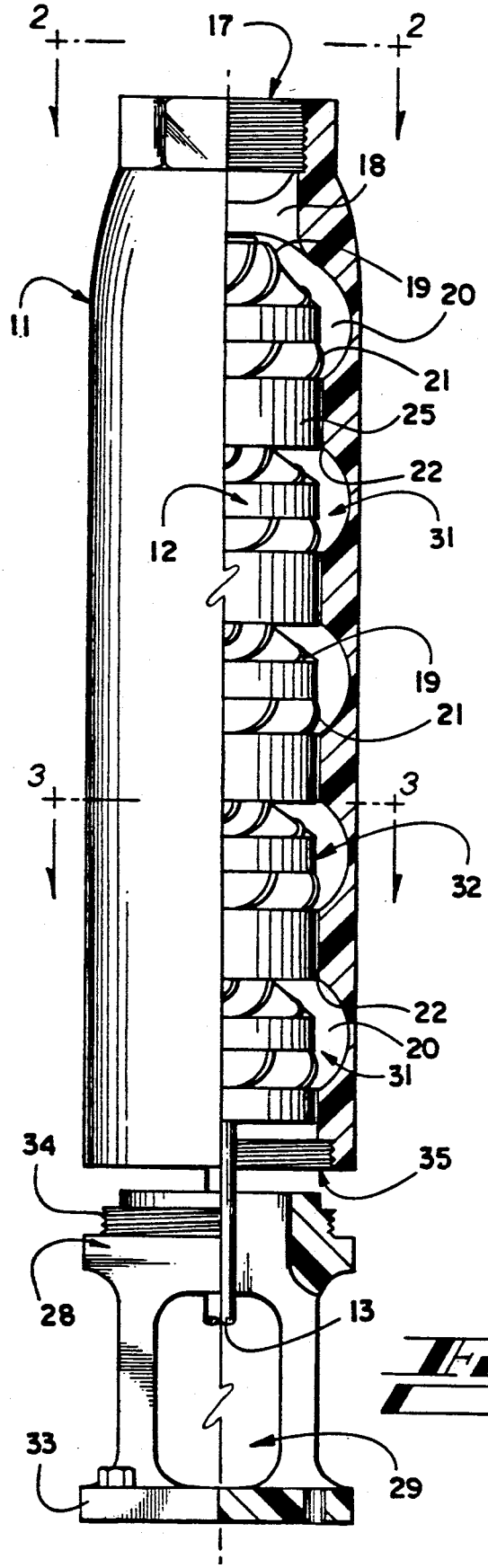
FIG. 1 is a vertical elevation view of the pump showing a portion thereof in section.
Figure 2:
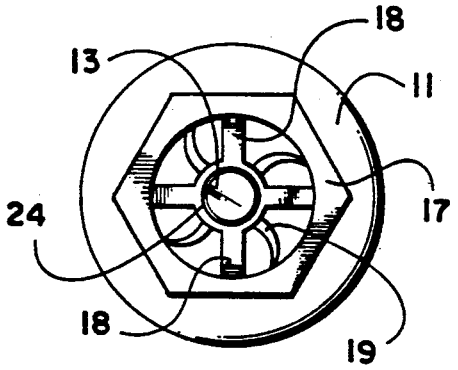
FIG. 2 is a top view of the pump taken along lines 2—2.
Figure 3:
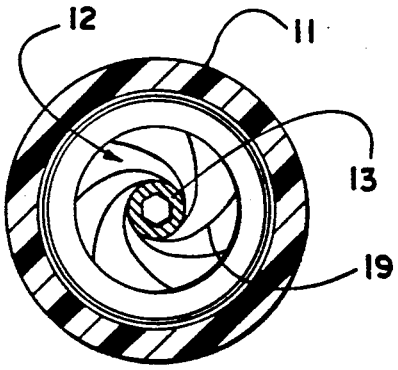
FIG. 3 is a horizontal section of pump taken along lines 3—3.

Referring to the drawings, wherein like reference characters designate corresponding parts throughout the several figures, the pump of the present invention is shown in its preferred embodiment by numeral 11 in Figure The diffusion casing 11 is a one-piece recurring diffusion casing made out of suitable material applicable for the uses to which the pump is to be put. The pump, as shown in FIG. 1, comprises, in the application shown, five (5) separate diffusion cycles with each of the cycles being generally indicated by the numeral 31, which indicates the general area of a single diffusion cycle. Within the casing 11 is a one-piece multiple turbine impeller 12 which functions similarly to the traditional vertical turbine impellers of the prior art, except that it is of a one-piece construction. The exact configuration of the impeller as to the number of vanes, their shapes, angles and thicknesses may be changed to meet various hydraulic conditions and, of course, may be made of various materials suitable for the task.

At the upper end of the submersible type pump shown in FIG. 1, the casing 11 terminates in a threaded discharge outlet 17 which also houses an upper radial support 18 comprising radiating arms meeting in the center of the casing to form a retaining bearing 24, whose purpose is to maintain the pump shaft 13 in proper alignment.

Each individual impeller section 32, there being one impeller section for each diffusion cycle 31, comprises multiple guiding vanes 19 which are molded or cast on the impeller section to assist in directing the water flow from the water passages 20 to the next impeller section 32 or through the discharge outlet, as the case may be. In the lowermost distal area of the impeller section are a plurality of impeller vanes 21, whose purpose is to forcibly move the water from one diffusion cycle to the next. Inasmuch as the present invention has a unitary diffusion casing 11 and impeller 12 and with the pump shaft 13 being supported only at the opposite ends of the pump, there are provided surfaces for dynamic support of the impeller during operation. Such a support area is more definitively shown by a re-entrant portion of the diffusion casing indicated by numeral 22 which provides a wear surface to correspond with multiple impeller shrouds 25, which surfaces are closely manufactured to give precise tolerances between the shroud 25 and the wear surface 22. Such tolerances allow a minute clearance to maintain a film of water therebetween to act as a lubricant and to insure smooth operation of the unit.

Figure 4:
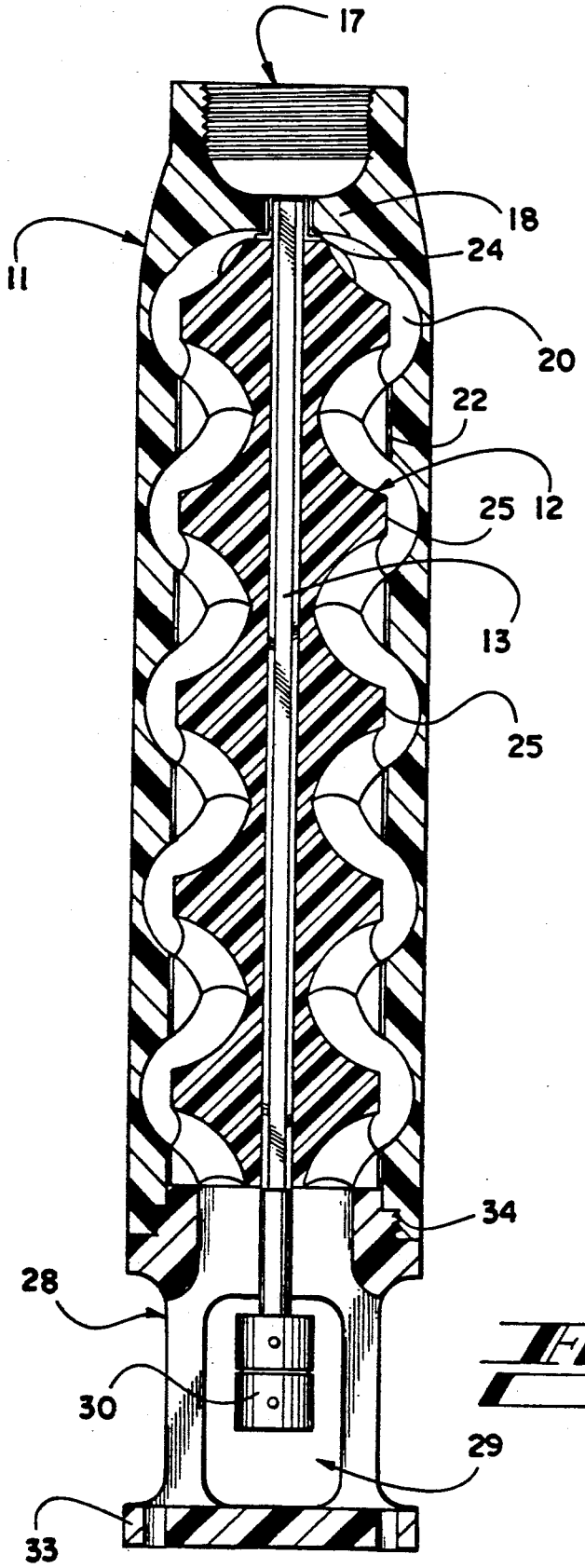
FIG. 4 is a vertical section of the pump of FIG. 1.
Figure 5:
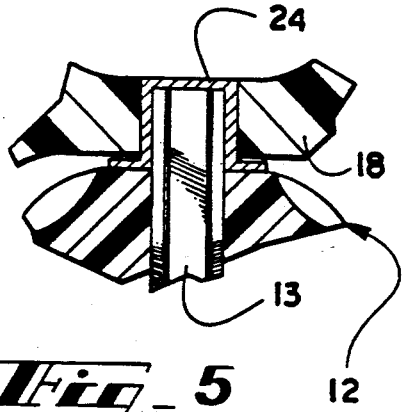
FIG. 5 is an enlarged sectional view of the upper bearing of the pump.

In normal submersible operation, the submersible pump, as shown in FIG. 1, would normally have an electric motor attached to the bottom, or distal, end to drive the pump in its intended mode. A typical electric motor would be affixed to flange 33 by suitable fasteners and would be supported on the threaded motor adaptor 28. As is apparent, adaptor 28, threaded at its upper end as indicated by numeral 34, is adapted to be matingly engaged with the lower threaded end 35 of the pump. As can be seen, the pump shaft 13 would project through the motor adaptor and would interconnect with the driving electric motor by means of the splined motor shaft coupling 30, as more particularly shown in FIG. 4. It is anticipated, as is customary, that the threaded motor adaptor 28 would be fitted with a screen 29 around the water intake openings 29 to keep undue trash from entering into the pump during the operation of the pump. Depending upon the materials utilized in a particular pump, it may well be that the pump shaft 13 may be molded in the impeller 12, or be of some polygonal profile to facilitate locking the impeller to the shaft without using other fastening devices.

Figures 8, 9:
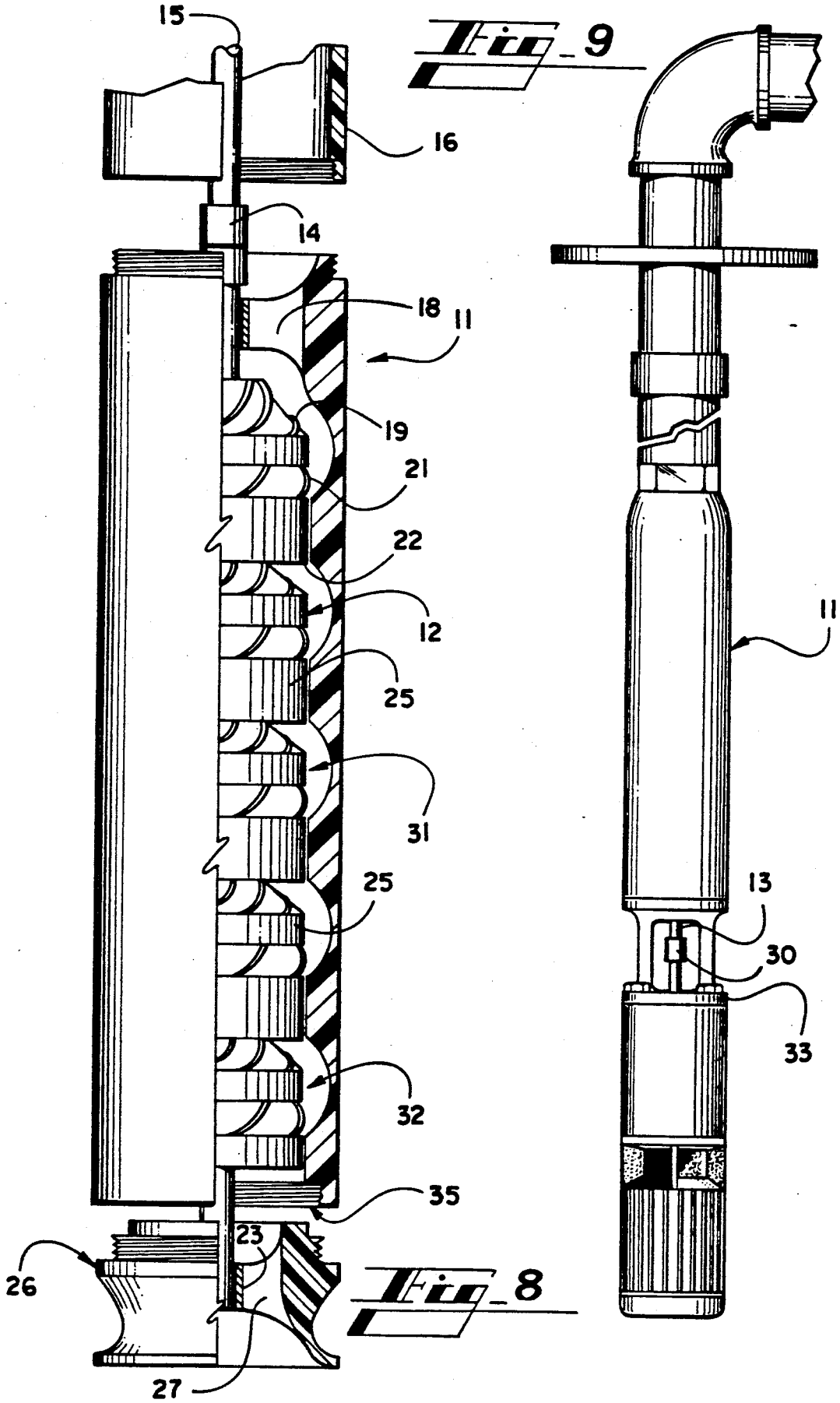
FIG. 8 is a elevation view of the pump in partial section showing the pump in a lineshaft configuration.
FIG. 9 is an elevation view of the pump configured in a submersible pump arrangement showing the pump attached to a supply line and having a driving electric motor attached to the lowermost portion thereof.

Turning now to an alternate embodiment as more particularly depicted in FIG. 8, there is shown a line shaft model of the pump which differs only in the manner in which it is coupled to a driving unit. In this configuration it is assumed that the driving motor is coupled to, and is mounted atop the pump at some distance therefor by means of coupling pipe 16. The pump is operated by the motor through line shaft 15 coupled to the pump shaft 13 by means of shaft coupling 14. At the distal end of this embodiment, a threaded suction bell 26 is threadingly engaged with the distal end of the pump, while the pump shaft 13 is maintained in proper alignment by sleeve bushing 23 maintained in proper position by means of the lower radial support 27.

Various modifications may be made of the invention without departing from the scope thereof and it is desired, therefore, that only such limitations shall be placed thereon as are imposed by the prior art in which are set forth in the appended claims.

What is claimed is:

1. A centrifugal pump for pumping fluid comprising, a one-piece, elongated diffusion chamber casing and a unitary peller unit mounted for rotation within the casing, the combination forming a unitary pump having an inlet end and an outlet end, the casing having exterior and interior sidewalls, the diffusion casing having at least one pumping chamber therein, the pumping chamber having a plurality of inwardly extending fluid directing vanes, the vanes being so configured to direct the pumped fluid within the chamber upwardly towards the outlet end of the pump, the pumping chamber being in fluid communication with the inlet end and the outlet end of the pump, unitary inwardly facing bearing means integral with the interior sidewalls of the diffusion casing, an impeller to effect movement of fluid through the pumping chamber and being located in the pumping chamber, the impeller comprising an upper end and a lower end and having fluid directing vanes therebetween, unitary outwardly facing bearing means integral with the impeller and positioned to be placed adjacent the bearing means of the diffusion casing to form a dynamic bearing surface between the impeller and the diffusion casing.

2. A centrifugal pump as claimed in claim 1, wherein the impeller has a circular lower impeller shroud and an upper impeller shroud, the lower shroud having a proximal end and a distal end, the proximal end being attached to the lower end of the impeller.

3. A centrifugal pump as claimed in claim 2, wherein the lower impeller shroud forms a circumferentially planar surface between the proximal end and the distal end thereof, and said planar surface forms a bearing surface positioned closely adjacent the diffusion casing bearing means thereby providing a dynamic bearing support between the impeller and the diffusion casing.

4. A centrifugal pump as claimed in claim 3, wherein the upper impeller shroud has a proximal end and a distal end, the proximal end being attached to the upper end of the impeller, a tapered guiding vane being attached to the distal end of the upper shroud wherein the guiding vane directs the pumped fluid through the diffusion casing pumping chamber.

5. A centrifugal pump as claimed in claim 4, wherein the diffusion casing comprises multiple pumping chambers.

6. A centrifugal pump as claimed in claim 5, wherein the pump comprises, multiple impeller segments each having an impeller section and a lower shroud and an upper shroud and a guiding vane, the guiding vane being stacked atop the upper shroud and the upper shroud being stacked atop the impeller section and the impeller section being stacked atop the lower shroud so that the guiding vane of a lower impeller unit is located adjacent and underneath the lower shroud of an upper impeller unit.

* * * * *